United States Patent [19]

Long

[11] Patent Number: 4,693,478

[45] Date of Patent: Sep. 15, 1987

[54] GOLF PUTTER HEAD

[75] Inventor: Dabbs C. Long, Albany, Ga.

[73] Assignee: MacGregor Golf Company, Albany, Ga.

[21] Appl. No.: 840,250

[22] Filed: Mar. 17, 1986

[51] Int. Cl.[4] ..... A63B 53/04

[52] U.S. Cl. ..... 273/164; 273/169; 273/80 C

[58] Field of Search ..... 273/169, 171, 172, 167 F, 273/170, 167 A, 167 B, 164, 167 E, 167 K, 163 R, 163 A, 175, 173, 174

[56] References Cited

U.S. PATENT DOCUMENTS

| | | | |
|---|---|---|---|
| D. 240,249 | 6/1976 | Chellman | D34/5 GC |
| D. 240,445 | 7/1976 | Becker | D34/5 GH |
| D. 248,783 | 8/1978 | Long | D34/5 GH |
| 3,516,674 | 6/1970 | Scarborough | 273/169 |
| 3,921,984 | 11/1975 | Winter | 273/164 |
| 3,931,975 | 1/1976 | Cook | 273/164 |
| 3,966,210 | 6/1976 | Rozmus | 273/169 |
| 3,967,826 | 7/1976 | Judice | 273/167 F |
| 4,010,958 | 3/1977 | Long | 273/169 |
| 4,136,877 | 1/1979 | Antonious | 273/164 |
| 4,147,357 | 4/1979 | Strop | 273/164 |
| 4,322,083 | 3/1982 | Imai | 273/167 F |
| 4,325,553 | 4/1982 | Taylor | 273/167 F |
| 4,444,395 | 4/1984 | Reiss | 273/171 |
| 4,458,900 | 7/1984 | Antonious | 273/164 |
| 4,508,350 | 4/1985 | Duclos | 273/183 D |
| 4,529,202 | 7/1985 | Jacobson | 273/168 |

*Primary Examiner*—George J. Marlo

*Attorney, Agent, or Firm*—Jones, Askew & Lunsford

[57] ABSTRACT

There is disclosed a golf putter head which is longer (5.5 inches or greater), wider (at least 1.30 inch), and higher (at least 1.375 inch) than a conventional putter head so that the putter head is easier to align initially and provides greater distance and control during putting. The putter head includes a blade having a striking face, a blade sole, a heel end, a toe end, and a rear face. A flange extends integrally and rearwardly from the blade and has enlarged heel and toe sections and reduced-thickness center portion forming a cavity behind the putter blade. The center section of the flange is between 0.125 and 0.375 inch in thickness to provide reinforcement against vibration to the thin blade. As a result of the mass distribution of the blade and flange, the center of mass is positioned vertically to coincide with the center of a golf ball being stroked, and the putter has a rotational moment of inertia about a vertical axis through the center of mass of greater than 5000 gm/cm$^2$. The putter head is cast of aluminum and weights between 265 and 330 grams. The putter head has a milled face smoothed to within 0.001 inch to eliminate skew on striking.

6 Claims, 7 Drawing Figures

GOLF PUTTER HEAD

BACKGROUND OF THE INVENTION

This invention relates generally to golf putters and more particularly concerns a golf putter head which provides a high rotational moment of inertia, a properly aligned center of mass, a reinforcing rearwardly extending flange, and a flat milled striking face, all of which combine to produce a putter having a high degree of accuracy.

In order to putt a golf ball accurately, it is necessary to align the length of the putter face perpendicular to the intended line of the putt, and then keep the length of the putter face perpendicular to that intended line when the ball is contacted during the putting stroke. In addition, accuracy as to distance depends on the amount of energy transferred from the putter head to the ball and how much of that energy is lost to vibration or extraneous torques imparted either to the ball or the club at the moment of impact.

With regard to initial alignment of the putter face, there have been a number of putters proposed which provide aligning indices on the putter which will assist the golfer in aligning the length of the putter blade perpendicular to the intended line of the putt. See, for example, Rozmus U.S. Pat. No. 3,966,210 with its groove along axis 5; Winter U.S. Pat. No. 3,921,986 with its rearwardly extending perpendicular flange 17; Becker U.S. Pat. No. De. 240,445; Antonius U.S. Pat. No. 4,136,877; and Antonius U.S. Pat. No. 4,458,900.

In order to maintain alignment of the length of the putter face perpendicular to the intended line of the putt, the prior art has also disclosed a number of golf putters which have increased rotational moments of inertia to offset the putter's tendency to twist if the ball is struck off of the center of mass of the putter head, either toward the heel or toward the toe of the putter head. Typically, as shown in Duclos U.S. Pat. No. 4,508,350, lead weight inserts are provided in the heel and toe of a standard size putter head cast from aluminum in order to increase the putter head's rotational moment of inertia. Duclos' putter head with its lead weights has a rotational moment of inertia of 4500 gm. cm.$^2$ about the center of mass of the putter head having a conventional static weight of 310 gms. Likewise, weighted putter heads having increased moments of inertia are disclosed in Taylor U.S. Pat. No. 4,325,553; Reiss U.S. Pat. No. 4,444,395; Winter U.S. Pat. No. 3,921,984; Judice U.S. Pat. 3,967,826; Strop U.S. Pat. No. 4,147,357; Cook U.S. Pat. No. 3,931,975; and Long U.S. Pat. No. De. 248,783.

In addition to weighted inserts in the heel and the toe of a putter head, the prior art also discloses weights in the putter head displaced rearwardly of the putter shaft. As the putter is swung forward, the inertia of the weights in the trailing outboard edges of the putter head tends to cause the club head to rotate such that the length of the face of the putter will be perpendicular to the intended line of the putt prior to striking the ball. Such putter heads with weighted trailing edges are disclosed in Rozmus U.S. Pat. No. 3,966,210 and Long U.S. Pat. No. 4,010,958.

In order to assure that the ball, when struck by the putter, travels as far as intended, it is important that the center of mass of the putter head and the center of the mass of the ball lie on a line parallel to the putting surface and aligned with the intended line of the putt. Such an alignment assures the maximum transfer of energy from the putter head to the ball and assures that energy is not wasted by imparting torsional forces to the ball which do not contribute to its linear velocity or by transmitting torsional forces to the putter head which are dissipated by the damping affects of the putter head, the shaft, and the golfer's grip. In addition, energy is transferred from the putter head to the golf ball by providing a putter head which is relatively free of vibration thereby producing a "solid feel" when the putt is struck.

Finally, accuracy in putting is further assured by having the striking face of the putter head as flat as possible. In general, standard putter heads are manufactured by casting which provides a striking face which may vary as much as 0.006 inch in overall smoothness.

SUMMARY OF THE INVENTION

It is therefore an object of the present invention to provide a golf putter head of a size, shape, and distribution of mass that is easy to align initially, has a high moment of inertia to resist twisting, has its center of mass positioned to coincide with the center of mass of the golf ball to be stroked, has a reinforcing flange to minimize vibration loss, and has a flat milled face to eliminate skew.

It is a further object of the present invention to provide a putter head that has a length from heel to toe greater than a conventional putter head and generally greater than 5.5 inches, is higher than a conventional putter head so that its center of mass vertically aligns with the center of a standard golf ball, and has a reinforcing, vibration damping flange which makes its overall width greater than that of a conventional putter head.

It is further an object of the present invention to provide a putter head in which the reinforcing flange has a center thickness between 0.125 inch and 0.375 inch to reinforce the blade of the putter and decrease vibrations thereof.

It is likewise an object of the present invention to provide a molded putter head which is cast from a single lightweight metal, such as aluminum.

It is further an object of the present invention to provide a putter head with a milled striking face which varies no more than 0.001 inch in overall smoothness.

Other objects and advantages of the invention will become apparent upon reading the following detailed description and upon reference to the drawings.

DETAILED DESCRIPTION OF THE INVENTION

While the invention will be described in connection with the preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
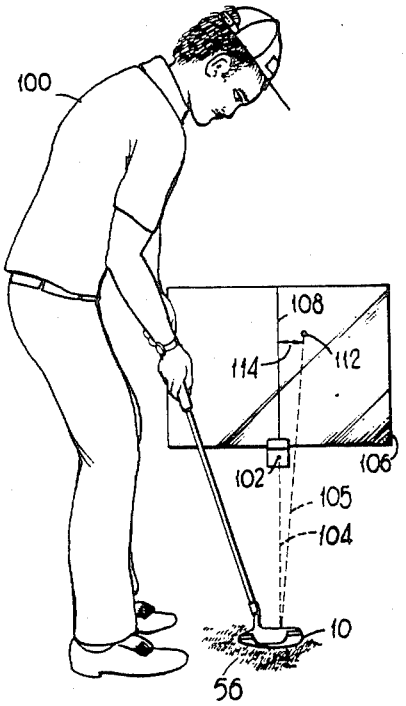
FIG. 1 is a perspective drawing showing a golfer initially aligning a putt to test putters made in accordance with the present invention against conventional putters.

In order to make an accurate golf putt, it is necessary for the golfer and putter to execute the following steps with reference to FIG. 1: (1) the golfer 100 must establish the intended line 104 for the putt; (2) the golfer must initially align the the length of the putter's striking face perpendicular to that intended line 104 of the putt; (3) the golfer must swing the club forward into contact with the ball so that just prior to the moment of contact the length of the striking face of the putter is still perpendicular to the intended line 104 of the putt; (4) the golfer must swing the club head with sufficient velocity to impart the necessary energy to the ball so that it will reach the hole; (5) the club on contacting the ball must consistently transfer its energy to the ball; and (6) the club on contacting the ball must maintain the perpendicular orientation of the face of the putter to the intended line of the putt.

Of those six steps, the design of the putter head can have a significant affect on the golfer's ability to align initially the putter face with the intended line of the putt, on the transfer of energy to the ball, and on the direction in which the energy is transferred to the golf ball being putted.

With regard to the initial alignment of the putter face to the intended line of the putt, I have found that an oversized putter head being both longer and wider than a standard putter head gives a golfer making his initial alignment a better frame of reference than a standard-sized putter head. A standard size putter head is typically 4.5 inches in length (heel to toe), 0.5 to 1.75 inch wide, 1.0 inch high, weighs between 265 and 330 grams, and has a rotational moment of inertia of between 2700 and 4650 gm.cm.$^2$ about its center of mass. When tested with golfers, the oversized putter head of the present invention provides at least a 2.7% greater degree of consistency over one standard putter and in another case as much as a 39.6% greater degree of consistent initial alignment.

With respect to transferring energy to the ball, the oversized putter head of the present invention has its center of mass higher than a conventional putter head so that the center of mass is in close vertical alignment with the center of the ball. Additionally, by providing a rearwardly extending flange having a center section thickness between 0.125 inch and 0.375 inch, the blade of the putter is reinforced to the extent that vibrations created in the putter head are damped, thus providing greater transfer of energy and a more solid feel when a golf ball is struck.

With respect to the direction of impact, the oversized putter head with its mass distributed in the heel and the toe gives an even greater rotational moment of inertia than conventional sized putter heads that use lead weights in the heel and toe. As a result, there is substantially less tendency for the putter head of the present invention to twist upon impact if the point of impact is slightly displaced from the locus of the center of mass between the heel and toe of the putter head.

Figure 2:
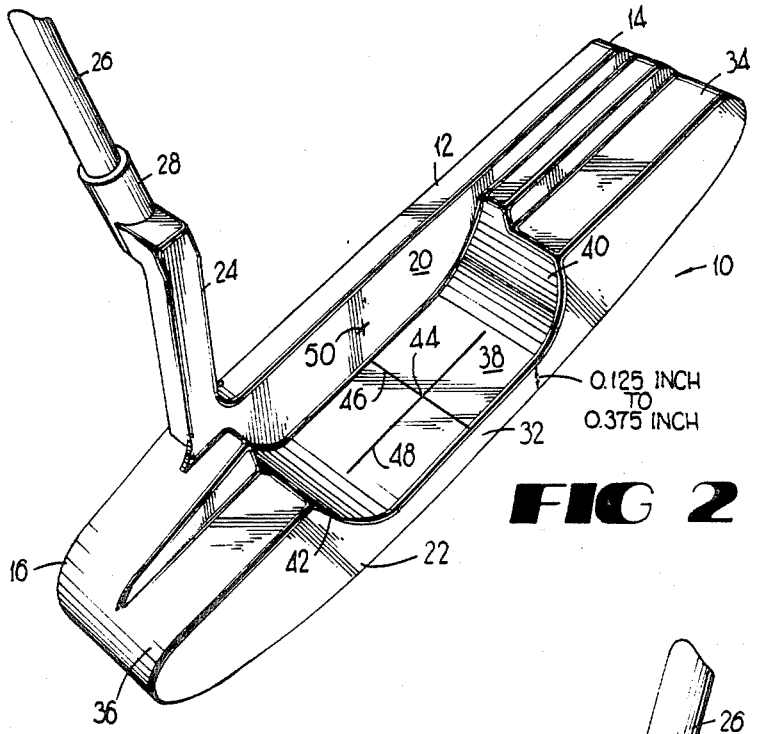
FIG. 2 is a perspective drawing of the putter head of the present invention.
Figure 3:
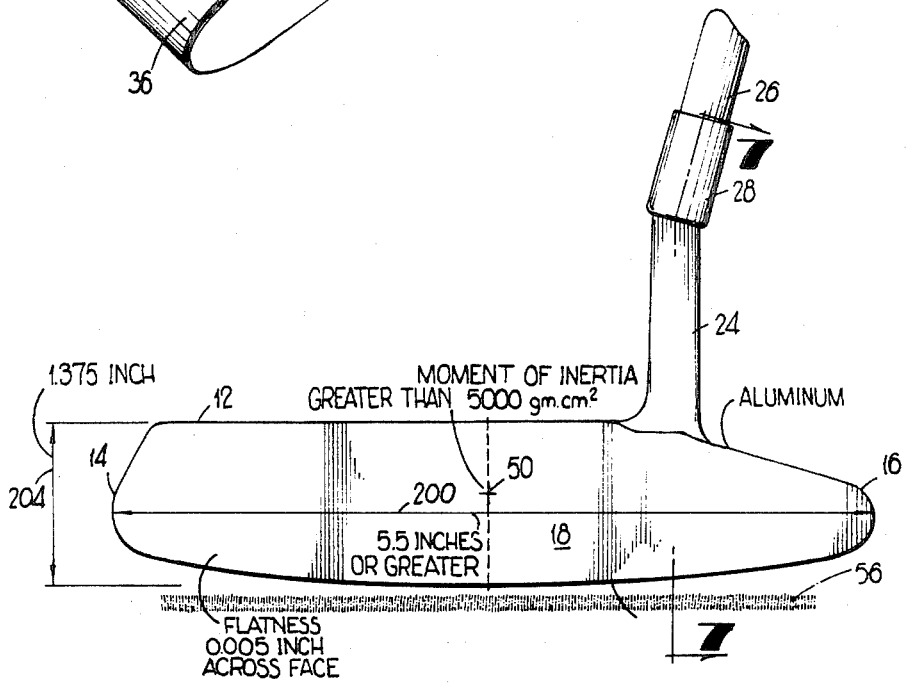
FIG. 3 is a front elevation view of the putter head of the present invention.

Turning to FIG. 2, a golf putter head 10 embodying the features of the present invention includes a thin, elongated blade 12 having a toe 14, a heel 16, a striking surface 18 (FIG. 3), and a back surface 20. A hosel 24 is connected to the top surface of the blade, and a shaft 26 is affixed to a cylindrical end portion 28 of the hosel.

A flange 22 extends rearwardly from the blade 12 so that the blade and flange together form a sole 30 (FIGS. 3 and 5) for the head 10. The flange 22 has a center portion 32 which is relatively thinner than its toe section 34 and its heel section 36. The thin center section 32 of flange 22 has a thickness between 0.125 inch and 0.375 inch and forms a cavity behind the blade 12. The cavity has a bottom surface 38 and side surfaces 40 and 42. The upper limit for the thickness of the center portion 32 is determined by the necessity of distributing the majority of the weight of the flange 22 in the flange sections 34 and 36 adjacent the toe 14 and heel 16 respectively. The distribution of the mass of the putter head 10 produces a center of mass located at 50. The center of mass 50 is located approximately one half of the distance between the toe 14 and the heel 16. By distributing the weight of the flange 22 in sections 34 and 36, the moment of inertia along the length of the blade 12 and about the center of mass 50 is maximized, which in turn results in a high moment of inertia about the shaft 26 of the putter.

Figure 4:
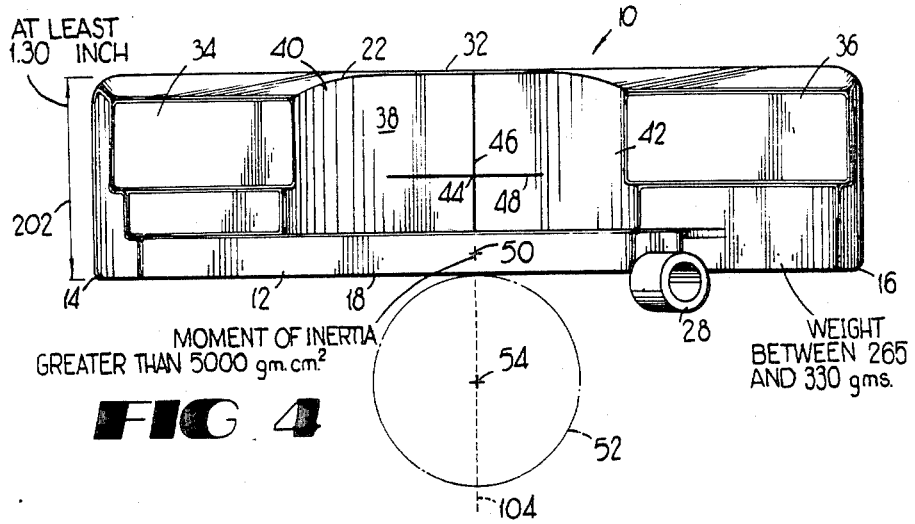
FIG. 4 is a top plan view of the putter head of the present invention.

Cross-hairs 44 comprising aligning index line 46 and parallel index line 48 are engraved or printed on the surface 38 of the flange 22. The index line 46 is perpendicular to the length 200 (FIG. 3) of the striking face 18 of the blade 12. As can be seen in FIG. 4, the aligning index line 46 and the center of mass 50 lie in a common vertical plane which plane is also intended to coincide with the center 54 of the ball 52 and the intended line 104 of the putt when, the putter head is properly aligned for a putt. The index line 48 is parallel to the surface 18 of the blade 12.

Figure 5:
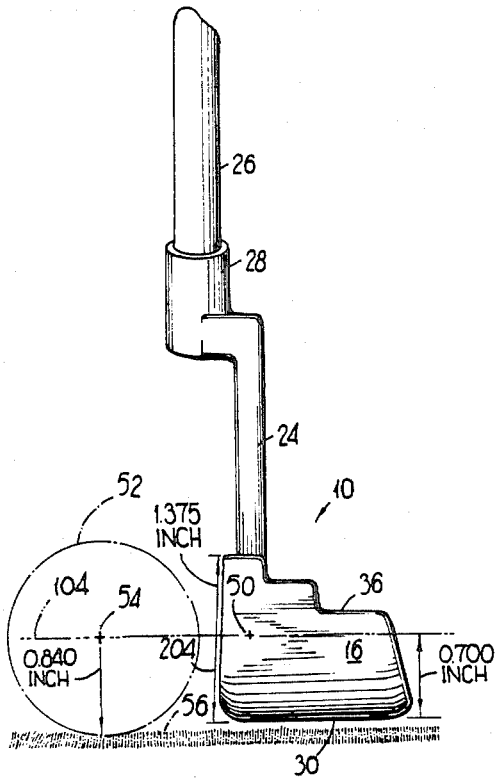
FIG. 5 is a side elevation view of the putter head of the present invention.

As can best be seen in FIG. 5, the putter head 10 has a height 204 of about 1.375 inch which is higher than a conventional putter head. Consequently, the center of mass 50 is located at a height above the sole 30 of the putter head so that when the putter head is raised slightly above putting surface 56 for putting, the center of mass 50 will be approximately in vertical alignment with the center 54 of a golf ball 52 to be putted. As a result, the putter head 10 will not impart a substantial rotational torque to the golf ball but will transfer its energy primarily into linear acceleration of the ball along the horizontal surface. Specifically, the radius of a ball 50 is 0.840 inch. The center of mass 50 of the putter head 10 is located at approximately 0.700 inch above the sole 30 of the putter head 10. When the putter is raised to putt, additional 0.100 inch to 0.150 inch is added to the height of the center of mass above the putting surface 56. Therefore, the center of mass of the putter head 50 and the center of mass of the ball are in approximate vertical alignment.

As previously mentioned, the overall length 200 (FIG. 3) of the putter head 10 is greater than that of a conventional putter which is generally 4.5 inches in length. In accordance with the present invention, the length 200 of the putter head 10 from heel 16 to toe 14 is from about 20% to 40% longer than a conventional putter, thereby being in the range of about 5.50 inches to 7.000 inches in length.

In order to give the golfer the proper perspective when initially aligning the putter head 10 having such increased length, it is advisable to increase the overall width 202 (FIG. 4) of the putter head which includes the width of the blade 12 and the width of the flange 22. The overall width 202 should be greater than 1.30 inch.

FIG. 1 illustrates a test procedure for checking the initial alignment experienced by a number of golfers using the putter of the present invention and several conventional sized competitive putters which have had mirrors attached to their striking faces. A golf ball 52 (hidden behind putter head 10) is placed on a putting surface 56 fourteen feet from a target 102. The golfer 100 then attempts to align the length 200 (FIG. 3) of the face 18 of the putter head 10 perpendicular to a line 104 which is the intended putting line directly across the flat putting surface 56 to the target 102. After the golfer has aligned the length 200 of the putter head 10 as close to perpendicular as possible, the golfer's view is obscured, the ball is removed, and a laser beam is projected from the target 102 along abutting line 104 to the mirror affixed to the face of the putter head 10. The reflection of the laser beam off of the mirror on the striking face of the putter head 10 follows line 105 and strikes an opaque screen 106 at a point 112. The screen 106 has a vertical center line 108 which is in alignment with the target 102 and the laser beam. A deviation 114 between point 112 and center line 108 is measured and recorded. After the deviation has been measured the laser is shut off, and the golfer repeats the process several times until a number of deviation readings have been taken. Subsequently, the golfer repeats the test with another golf putter. Each putter was tested by 23 golfers, and each golfer aligned each putter 3 times.

A golf putter manufactured in accordance with the present invention by the assignee of the present invention and identified by the trademark RESPONSE Z/T was compared to the golf putters listed in Table I. The percentage in Table I shows the degree of consistency by which the golfers were able, on average, to align the RESPONSE, Z/T golf putter of the present invention as compared to the other putters. The competitive conventional putters were identified as putters A, B and C. The thin elongated blade was as long as the RESPONSE Z/T putter of the present invention but was about ½ inch wide. The thin elongated putter was made to determine whether or not the length of the putter head alone was the determining factor for accuracy of initial alignment. As can be seen from Table I, it appears that length alone does not explain the accuracy of the initial alignment of the RESPONSE Z/T putter made in accordance with the present invention. It is believed that it is likewise necessary to have the increased width of the flange which allows sufficient width to provide a space for index line 46 which is long enough to provide a meaningful aid in aligning the putter head with the intended line of the putt.

TABLE I

| Competitive Putter | Comparative Consistency of initial alignment: RESPONSE Z/T more consistent (%) |
|---|---|
| A | 18.5% |
| B | 2.7% |
| C | 8.6% |
| Thin Elongated Blade | 39.6% |

In order tomaintain proper alignment of the putter head 10 upon impact with the ball, the putter head 10 with its greater length than a conventional otational moment of inertia putter has a higher about its center of mass than conventional putter heads. The rotational moment of inertia for a putter is determined by using a Space Electronic Inertia tester manufactured by Space Electronics of Meriden, Conn. 06450. The device consists of a small cup or platform attached to a torsion spring and mounted on bearings such that the platform or cup will oscillate back and forth in a horizontal plane when disturbed. An electronic counter is then attached to the device to time the period of the oscillations. By placing a known element on the platform or cup and recording the period of oscillation the spring constant of the system can be established. Once this is done, other unknown elements can be oscillated and their moment of inertia about the rotational center of the device calculated.

A homogeneous test bar, which was 0.375 inch wide, 0.375 inch high (H) and 8.656 inches long (L) and weighed 155.6 gm (M), was used to calibrate the device. The moment of inertia (Iy) of the test bar about its center was:

$$Iy = \frac{1(M)(H^2 + L^2)}{12}$$

$$Iy = \frac{(155.6)(0.9525^2 + 21.99^2)}{12}$$

The period of oscillation (T):

$$T = 2\pi\sqrt{\frac{Iy}{K}}$$

where K is the spring constant.

$$K = \frac{4\pi^2(Iy)}{T^2}$$

For the test bar T=0.744 second:

$$K = \frac{4\pi^2(6280.14)}{0.5535}$$

$$K = 447{,}902.2\ \frac{\text{gm cm}^2}{\text{sec}^2}$$

Now for any body placed on the platform or cup:

$$Iy = K\left(\frac{T}{2\pi}\right)^2$$

In determining the moment of inertia of a putter head, the head is removed from the shaft and placed on the platform or cup of the test device. The striking center of the blade is aligned with the rotational center of the device, and the head is displaced. The system now oscillates, and the period of those oscillations is measured by the counter.

It might be noted that on competitive putters if an alignment mark was supplied on the putter, this was assumed to be the striking center; if a mark was not supplied, the center of the blade was taken as the striking center.

Four putters were made in accordance with the present invention and were designated MI-700, MI-540, MI-615, and MI-640. MI-700 was essentially the same as the putter shown in FIG. 2 (about 1.625 inch wide) and weighed 290 gms. MI-540 was similar to the putter shown in FIG. 2 except that it was narrower (1.3 inch wide), and it had lead inserts imbedded in the heel and toe although its weight was maintained at 290 gms. The MI-615 putter was the same as the putter shown in FIG. 2 except it was narrower (about 1.375 inch wide), its back design was slightly different, it had lead inserts in the heel and toe, and it weighed 277 gms. The MI-640 putter was similar to the putter shown in FIG. 2 except it was narrower (about 1.375 inch wide), it had lead weights in the heel and toe, and it had an overall weight of 273 gms.

The four putters MI-700, MI-540, MI-515, and MI-640 were tested for rotational moments of inertia and compared to four conventional putters, C, E, A, and Bullseye. The Bullseye style putter is manufactured by MacGregor Golf Company, 1601 South Slappey Boulevard, Albany, Ga. 31707, assignee of the present invention.

Table II tabulates the measured rotational monents of inertia of each of the putter heads.

TABLE II

| Putters | Length (Inches) | Width (Inches) | Height (Inches) | Weight (Grams) | Mass Moment of Inertia (Gram Cm$^2$) |
|---|---|---|---|---|---|
| MI-700 | 6.20 | 1.64 | 1.42 | 290 | 6,263 |
| MI-540 | 6.25 | 1.30 | 1.40 | 290 | 6,263 |
| MI-615 | 6.00 | 1.37 | 1.40 | 277 | 5,687 |
| MI-640 | 6.25 | 1.375 | 1.46 | 273 | 5,385 |
| C | 4.60 | 1.19 | 1.03 | 319 | 4,603 |
| E | 4.80 | 1.00 | 0.98 | 306.6 | 3,829 |
| A | 4.53 | 1.15 | 0.97 | 300.8 | 3,357 |
| Bulls-eye | 4.45 | 0.62 | 0.90 | 338 | 2,724 |

As can be seen from Table II, the putter heads made in accordance with the present invention all had rotational moments of inertia above 5,000 gm. cm.$^2$ and above the rotation moments of inertia for the competitive putters.

Not only does the rotational moment of inertia contribute to putting accuracy, but also the flatness of the putter face helps assure that putts will not be propelled off line. The putter head 10 also provides a higher degree of accurary as a result of the striking face 18 being milled flat to within less than 0.005 inch of variation across its surface. Preferably the milling provides variations in smoothness of less than 0.001 inch across the surface 18 of the putter face. Conventional putters made by casting typically have variations in excess of 0.006 inch.

In addition, in order to establish that the putter head design of the present invention is superior to those of competitive putters, I conducted a test in which a mechanical putting machine was used to stroke the putt in exactly the same way each time. Each putter was mounted in pendulum fashion, pulled back to a fixed point, and released. As a result, at impact the head for each putter tested would have the same velocity. It will, however, be appreciated that the heavier conventional putter heads would have more energy to transmit the ball.

Figure 6:
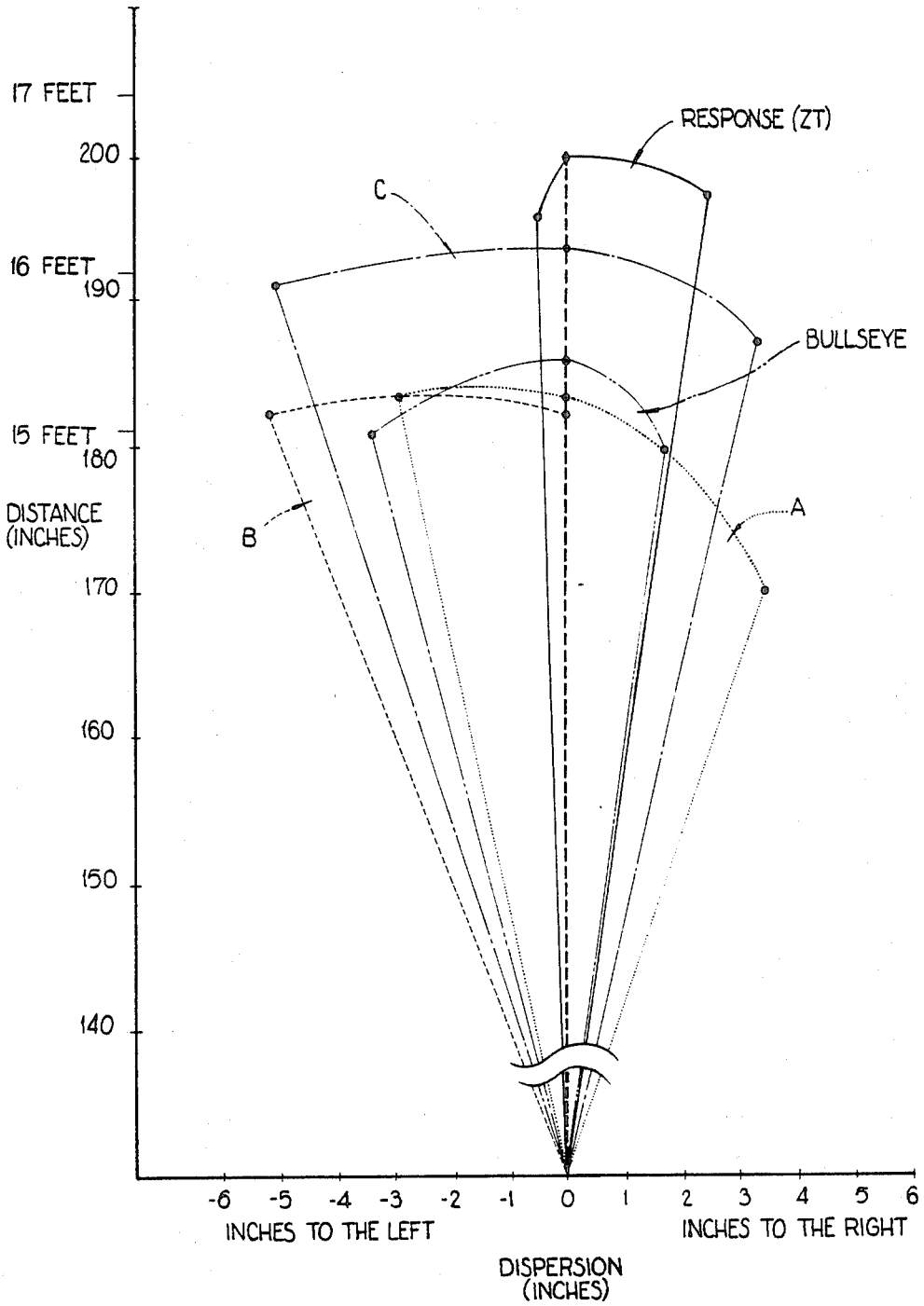
FIG. 6 is a graph showing the locus of putts struck by an automatic putting machine using the putter of the present invention and four conventional, competitive putters.
Figure 7:
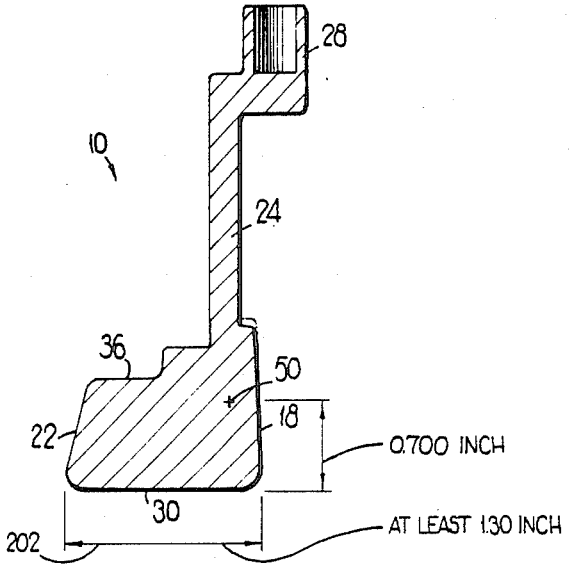
FIG. 7 is a section of the putter head of the present invention as shown along line 7—7 of FIG. 3.

By positioning the ball off-center to the heel or toe of the putter head about one-half inch, I was able to plot the dispersion pattern for each type of putter. In addition to the RESPONSE Z/T putter (MI-700) (290 gms.) made in accordance with the present invention, I also tested the C putter (319 gms.), a Bullseye style putter (338 gms.), the A putter (300.8 gms.), and the B putter. As can be seen in FIG. 6, the RESPONSE Z/T (MI-700) putter produced a substantially more consistent dispersion than the other putters tested. In fact, the B putter, even when the ball was moved to the right of the center of mass, still putted each time to the left.

Also, it should be noted that the lighter RESPONSE Z/T (MI-700) putter was consistently longer than the competitive putters even though at a constant velocity it had less energy to transmit to the ball. It is my belief that the increased length results from the wider and thicker flange center portion 32 on the putter which provides rigidity and eliminates vibration losses. Greater distance also appears to result from the vertical alignment of the center of mass of the RESPONSE Z/T putter head and the center of the ball. Such alignment apparently results in more energy being transferred from the putter head to the ball. Also, the higher rotational moment of inertia of the RESPONSE Z/T putter head would appear to explain the greater distance for the RESPONSE Z/T putter.

I claim:

1. A golf putter head which weighs between 265 and 330 grams and has a center of mass comprising:

(a) a blade a striking face, a blade sole, a heel end, a toe end, and a rear face wherein the blade has a width, a height greater than the radius of a standard golf ball, and a length of 5.5 inches or greater;

(b) a hosel attached to the blade;

(c) a flange having a top surface and a flange sole and integrally extending rearwardly from the blade adjacent the blade sole wherein the blade sole and the flange sole form a putter sole and the flange has a length equal to the length of the blade and a width greater than the width of the blade and such that the combined width of the blade and flange is at least 1.30 inch and wherein the flange has a reduced thickness center portion to create a cavity behind the blade and increased thickness portions adjacent the heel and toe of the blade, wherein the mass of the head is distributed to establish a locus for the center of mass approximately one half way along the length of the blade and along the height of the blade at a vertical distance from the sole which when the putter head is raised for putting above a putting surface the center of mass is aligned vertically with a center of a standard golf ball resting on the putting surface and to establish a rotational moment of inertia about the center of mass greater than 5000 gm. cm.$^2$.

2. The putter head of claim 1, wherein the center portion of the flange is between 0.125 inch and 0.375 inch in thickness.

3. The putter head of claim 1, wherein hosel, the blade, and the flange are molded from a single lightweight material.

4. The putter head of claim 3 wherein the material for the hosel, the blade and the flange is aluminum.

5. The putter head of claim 1, wherein the striking face is flat to a variance of less than 0.005 inches.

6. The putter head of claim 1, wherein a first index line is provided on the top surface of the flange in the cavity disposed perpendicular to the length of the blade and located in a vertical plane incorporating the center of mass and a second index line is provided on the top surface of the flange in the cavity disposed perpendicular to the first index line and parallel to the striking face.

* * * * *